United States Patent [19]

Niederhauser

[11] 4,233,349

[45] Nov. 11, 1980

[54] SUEDE-LIKE PRODUCT AND PROCESS THEREFOR

[75] Inventor: Donald O. Niederhauser, Wilmington, Del.

[73] Assignee: E. I. Du Pont de Nemours and Company, Wilmington, Del.

[21] Appl. No.: 23,967

[22] Filed: Mar. 26, 1979

[51] Int. Cl.[2] ..... B32B 3/02

[52] U.S. Cl. ..... 428/92; 28/104; 156/181; 428/96; 428/245; 428/252; 428/253; 428/254; 428/257; 428/290; 428/904; 428/423.7; 428/480

[58] Field of Search ..... 428/91, 92, 93, 96, 428/225, 245, 253, 254, 257, 290, 425, 252; 28/104; 156/181

[56] References Cited

U.S. PATENT DOCUMENTS

| | | | |
|---|---|---|---|
| 3,266,969 | 8/1966 | Makansi | 428/92 |
| 3,988,488 | 10/1976 | Civardi | 428/904 |
| 4,055,693 | 10/1977 | Civardi | 428/904 |
| 4,104,488 | 8/1978 | Lui | 428/92 |
| 4,109,038 | 8/1978 | Hayashi | 428/91 |
| 4,122,223 | 10/1978 | Civardi et al. | 428/904 |

*Primary Examiner*—James J. Bell

[57] ABSTRACT

A suede-like fabric is produced by impinging a sheet-like structure of discrete fibrillatable fibers with needle-like columnar streams of liquid whereby the fibers are fibrillated to form a close spacing of subdenier fibril ends that extend from the sheet structure at randomly spaced intervals to form one surface of the suede-like fabric with a majority of the fibril ends being tapered.

18 Claims, 6 Drawing Figures

50X

100X

200X

500X

SUEDE-LIKE PRODUCT AND PROCESS THEREFOR

TECHNICAL FIELD

This invention relates to suede-like fabrics and more particularly, to suede-like fabrics of fibrillatable fibers composed of synthetic polymers, wherein the fabric has at least one surface comprised of numerous subdenier tapered fibril ends, and to a process for making the fabric.

BACKGROUND OF THE INVENTION

Natural suede leather is traditionally made by buffing the surface of a leather, usually the under or flesh side, with a carborundum or emery wheel to separate the natural fibers comprising the leather into a fine nap to provide a soft, luxurious, appealing, velvet-like surface. Fine suedes have a characteristic, multi-toned or subtly mottled appearance which is visibly altered when the fingers are traced across the surface ("finger-tracking effect"). The tactility and appearance of suede leather results from the multiplicity of fibrils raised on its surface, the fibrils being fine enough to respond readily to the touch and remain somewhat displaced laterally when the fibrils are moved, but having sufficient stiffness and resilience to retain the napped character of the surface.

Efforts have long been made to produce suede-like fabrics which simulate suede leathers. Particularly desired have been fabrics with subdenier surface fibers, i.e. surface fibers having a linear density of less than 1 denier per filament (less than 0.11 tex per filament). The term "suede-like" as used herein, is intended to comprehend fabrics having at least one raised nap surface comprised of closely-spaced fibers of low linear density and characterized by a soft, luxurious hand, regardless of basis weight of the fabrics. One commercial method for making such fabrics has involved preparing a woven or knitted fabric of wool, cotton, or one of the synthetic fibers, followed by napping of one or both fabric surfaces and shearing of the nap. Among the disadvantages of these fabrics has been insufficient fineness of the nap. Another commercial method has involved electrostatic deposition of fine flock fibers upon a fabric coated with adhesive. Although such flocked fabrics can be made with a suede-like surface comprised of somewhat finer fibers than the napped fabrics, they lack the luxurious tactility of suede leathers. In addition to commercially known products, other suede-like products are disclosed by the prior art. Evans, for instance, discloses in Example 57 of his U.S. Pat. No. 3,485,706 subjecting a polyethylene film-fibril sheet of continuous plexifilamentary strands to high-energy-flux streams of water to make a product having a suede-like texture; however, the fabric so prepared is limp or "dead" and has a waxy hand lacking in luxurious tactility.

Another approach to the problem of creating suede-like fabrics is described in British Pat. No. 1,300,268 wherein special composite fibers, designating as "islands-in-a-sea" fibers and comprising a plurality of superfine filamentary constituents (island component) in a matrix of a different constituent (sea component) are extruded and a fabric is prepared from the fibers, after which a pile of the fibers is formed on the surface of the fabric. The matrix of the composite fibers is then leached away, leaving a pile of superfine fibers. Finally, the fabric is impregnated with polyurethane and buffed. A disadvantage of this composite fiber is that the sea constituent is not utilized in the end use of the fiber resulting in a high cost for the end product. An analogous product, described by Nishida et al. in U.S. Pat. No. 4,073,988, is also based on the use of a special composite fiber, which can be split into numerous filamentary constituents by solvents having a swelling action upon the fiber. The fibers are knit into fabric form and a nap is raised before they are split; and the fabric having a nap of superfine filaments is then impregnated in turn with a water soluble polymer and a polyurethane, after which it is buffed. Another such product, described by Hayashi et al. in U.S. Pat. No. 4,051,287, relies on a hollow composite fiber which divides into numerous very fine fibrils. While such products closely resemble suede leather, each has limitations and they all involve complex and expensive processes. Accordingly, a need has been felt for a more versatile suede-like fabric which can be made by a simpler manufacturing process.

SUMMARY OF THE INVENTION

In accordance with the present invention, a process is provided whereby a drapeable fabric of fibrous synthetic polymer is produced which has a soft, suede-like tactility. When the fabric has a high basis weight or when it is impregnated with a soft resin in an appropriate amount to enhance body, the fabric closely resembles natural suede leather. In unimpregnated form, the fabric is lively as well as supple and has a soft, luxurious hand and tactility suitable for top quality lounging robes, sports shirts, and other wearing apparel. The fabric is also characterized by good cover, the convenience of wash-wear launderability and high water absorbency and wickability.

Briefly described, the suede-like fabric structure of the present invention includes a ground fabric comprising discrete fibrils, said fibrils extending from said ground fabric at randomly spaced points of attachment and with a close spacing of fibril ends to form one surface of the suede-like fabric, the majority of said fibril ends being tapered along their length. The close spacing of tapered fibril ends provides a surface characterized by a multiplicity of ends of very narrow width, imparting a soft, smooth luxurious tactility to the surface; while the larger width of the trunks of the tapered fibrils imparts sufficient stiffness and resilience to the surface that it is suede-like in character rather than limp. The ground fabric, which may include discrete fibers as well as discrete fibrils, is characterized both by the drape and by the resilience of conventional fabrics; while body is added to the suede-like fabric of the invention by impregnation with an amount of soft polymer appropriate to the amount of fabric body desired.

To produce the suede-like fabrics of the invention, discrete fibrillatable fibers are first formed into a suitable sheet-like structure, i.e., a woven, knitted, or nonwoven fabric of continuous filaments or staple fibers. The sheet-like structure is supported on a forminous support and impinged with needle-like columnar streams of liquid at a pressure sufficient to fibrillate the filaments, usually at least 5000 kPa, whereby the fibers are fibrillated to form a close spacing of fibril ends that extend from the sheet structure at randomly spaced intervals to form one surface of the suede-like fabric with the majority of said fibril ends being tapered. The foraminous support is preferably a fine mesh screen. To add body to the suede-like structure, the fabric may be impregnated with a soft polymer in an additional step, after it has been impinged with streams of liquid.

DETAILED DESCRIPTION OF THE PREFERRED EMBODIMENTS

In accordance with the invention, the sheet-like structure to be subjected to the hydraulic needling process is prepared from fibrillatable fibers. More specifically, such fibers are characterized in that they yield tapered fibrils when subjected to hydraulic needling. A fibril is defined herein as a small filament or fiber partially or completely detached from a larger fiber of which it was originally an integral component. Fibers are readily tested to determine whether they are fibrillatable by wrapping them around a frame, or otherwise securing them on the frame, and passing the frame several times beneath one or more hydraulic needling jets to subject the fibers to the needle-like columnar streams of liquid, e.g. at a pressure of 10,000 pKa. The pressure of the liquid in the jet and the number of passes under the jets can be varied to determine the optimum conditions for fibrillation of fibers supplied in any available form including yarns, continuous filaments, staple fibers or fabrics. There is great variation in the propensity of fibers to fibrillate when subjected to hydraulic needling. Fibers which are highly suited for fibrillation include polyethylene terephthalate fibers having a bladed cross section, such as a Y-shaped cross section with relatively thin fins or a thin ribbon cross section, e.g. one having a ratio of length to width of at least 3:1.

The sheet-like structures formed from the fibrillatable fibers can be made from either continuous filaments or staple fibers in the form of a batt or in the form of yarns woven or knitted into a fabric. If desired, other fibers may be present which have little or no tendency to fibrillate when subjected to hydraulic needling. For instance, reinforcing filaments or fibers may be present together with the fibrillatable fibers in the batt or in the same or different yarns in knitted or woven fabrics.

The sheet-like structure of fibrillatable fibers is hydraulically needled, using conventional hydraulic needling technology. For the purpose of the present invention it is preferred to support the sheet-like structure on a fine mesh screen, e.g. a screen having approximately 40 or more openings per centimeter in each direction. One side of the sheet structure is preferably subjected to several rows of the needle-like columnar streams of liquid—if desired, by passing the sheet-like structure under the same row of jets several times—after which the sheet-like structure is preferably turned over and hydraulically needled with several rows of the needle-like columnar streams of liquid on the other side of the fabric. If desired, the sheet-like structure can be turned over one or more additional times for further hydraulic needling.

Figure 1:
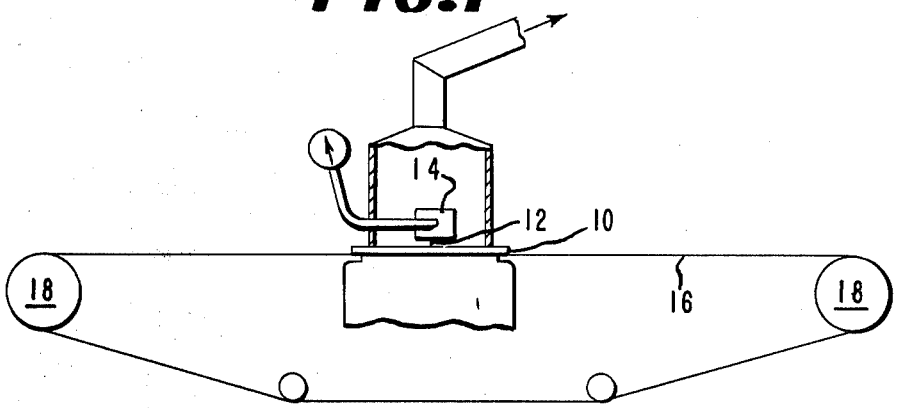
FIG. 1 is a schematic illustration of a process for making the suede-like fabric of the invention involving one stage of hydraulic needling.

FIG. 1 illustrates a single stage hydraulic needling process suitable for making the suede-like fabric of this invention wherein a sheet-like structure made of fibrillatable fibers placed on a screen 10 is passed beneath a line of closely spaced fine columnar streams of liquid 12 (only one of which is visible) issuing from a manifold 14. The screen 10 is positioned on a reversibly movable endless belt 16 traveling in a path determined by rollers 18. The passage of screen 10 beneath the streams 12 is in effect a traverse of the streams across one face of the sheet-like structure of fibrillatable fibers whereby the fibers of the sheet-like structure are fibrillated to form a close spacing of fibril ends that extend from the sheet structure at randomly spaced intervals to form one surface of the fabric. The majority of the fibril ends are tapered. The operating conditions are disclosed in Examples 1–6.

Figure 2:
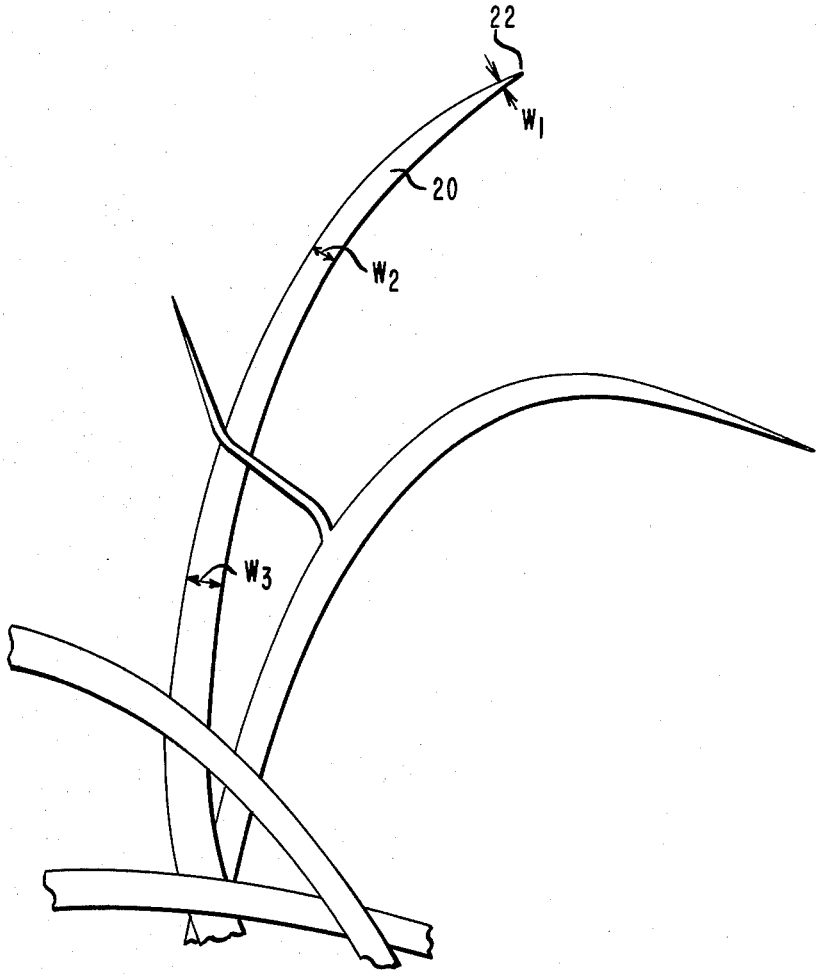
FIG. 2 is a schematic illustration of a fibril end illustrating measurement locations for the Fibril Taper Test.
Figure 3:
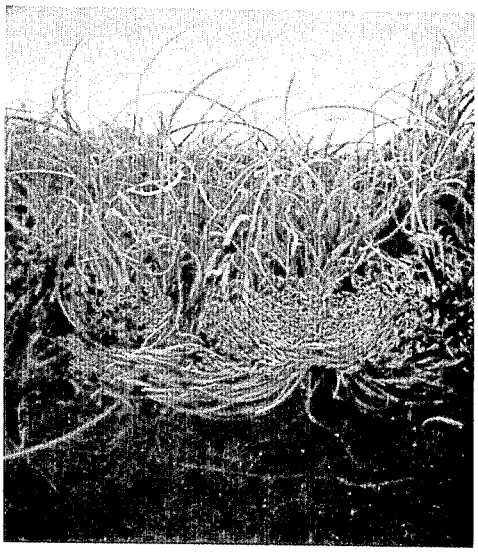
FIG. 3 is a photomicrograph at 50× magnification of a cross section of the fabric made in Example 1.

When the sheet-like structure is hydraulically needled, the fibers which comprise it become fibrillated to form fibrils tapering to ends of small width similar to that indicated as tapered fibril end 20 in FIG. 2 and others readily identifiable in the photomicrographs of the fabric of Example 1 shown in FIGS. 3–6. By the hydraulic needling action the fibrils also become interentangled with one another and with fibers or portions thereof which do not become fibrillated. When the initial sheet-like structure is a batt, the interentanglement of fibrils and fibers transforms the batt into a nonwoven fabric. When the initial sheet-like structure is a woven or a knitted fabric, the interentanglement of fibrils and fibers forms bridges across spaces between yarns in the initial fabric, increasing the cover of the fabric and locking the yarns together to form a more unified structure. A raised surface of tapered fibrils is provided by the hydraulic needling step on at least one side of the product, imparting a soft, luxurious, suede-like hand. After completion of the step, the wet fabric is boiled off and then dried or heat-set, and it may also be dyed if desired.

If it is desired to make a fabric having the appearance and tactility of natural suede leather, the fabric is further finished by impregnating it with a soft polymer to impart additional body to the fabric. The soft polymer may be an elastomer such as a polyether- or polyester-type polyurethane urea or an acrylonitrile-butadiene rubber; or it may be a nonelastomer such as plasticized polyvinyl chloride. Mixtures can be employed. After impregnation the fabric surface is usually buffed.

The term "ground fabric", as used herein, refers to the basic, substantially two-dimensional portion of the fabric which serves as the main body or foundation supporting the raised surface. Because the ground fabric is formed of discrete fibrils, which may include discrete fibers, interentangled with one another—and with additional weave geometry or interlocking stitch geometry when the initial sheet-like structure was a woven or knitted fabric—the product has the desirable characteristics of a two-dimensional flexible sheet, exhibiting liveliness and resilience as well as good drape. The interentanglement of the fibrils and fibers with one another imparts the properties of good bulk and excellent cover.

The fibrils extend from the ground fabric at randomly spaced points of attachment, and with a close spacing of fibril ends, to form at least one surface of the suede-like fabric. As used herein, the term "points of attachment"

is meant to include both the attachment at its base of a fibril into the larger fiber of which it was originally an integral component and the attachment by interentanglement of a fibril which has become completely split off from the larger fiber of which it once formed a part. A fibril end is defined herein as the visible part of any fibril having an unattached terminal point; free end is a more general term which is defined as the visible part of any fibril or fiber having an unattached terminal point. The points of attachment of many fibrils are related to the positions of the fibers in the original sheet-like structure, but are random along the length of such fibers. The fibrils are spaced at irregular intervals and are not clustered in a definite pattern.

The product is additionally characterized by the presence of tapered fibril ends in the raised surface, the tapered fibril ends being a majority of the free ends which comprise the raised surface. The tapering of the fibrils, which are pointed or narrow near their terminal points and which have broader trunks near their points of attachment in the ground fabric, provides a soft, luxurious surface because of the fineness of the fibril ends, while the thickening of the fibrils in the underlying structure and their interentanglement with one another provide a resilient base for the slender fibril ends which adds to the luxurious tactility of the surface. Many of the fibrils are also branched. Sanding and/or buffing the surface, e.g. after impregnation of the fabric with a soft polymer, leaves many of the tapered fibrils unchanged, while other fibrils still remain tapered with somewhat blunted ends which are still relatively narrow at the tip . The width of the tip is measured in accordance with this invention at a distance of $2\mu$ from the terminal point of the fibril end. The measurements of the tapered fibril ends are more readily understood by referring to FIG. 2. In determining the taper of the fibril end 20, width measurements are made at $w_1$ which is $2\mu$ from its terminal point 22 and at $w_3$ which is $100\mu$ from 22. At $w_1$, the fibrils have a maximum average tip width of no more than $10\mu$, preferably no more than $6\mu$. The minimum average tip width, $w_1$, of the fibril end, is about $0.5\mu$. Because the fibrils are tapered, the average width of the trunk of the fibril at a distance of $100\mu$ from its terminal point, i.e. $w_3$, is usually in the range of 1.5 to $10\times$ the average width of the fibril at a point only $2\mu$ from its terminal point. The maximum average trunk width, measured $100\mu$ from the terminal point of the fibril, is about $20\mu$, but preferably no more than $12\mu$; and the minimum average trunk width at a distance $100\mu$ from the terminal point of the fibril is about $2\mu$. A majority of the fibril cross sections have a smaller dimension in one direction through the center of the cross section (thickness) than the width dimension in the direction perpendicular to it. The thickness of the fibrils, measured $100\mu$ from the terminal point of the fibril, is in the range of $1\mu$ to $8\mu$.

The suede-like character of the fabric surface is also dependent on the close spacing of the tapered fibril ends. While in accordance with the present invention, at least about 5000 and preferably 10,000 of the fibril ends are provided for each square centimeter of fabric surface, much higher counts, up to 100,000 fibril ends per square centimeter or even more, may be encountered.

Description of Tests

Several of the tests described below involve examination of a sample of fabric under a scanning electron microscope (SEM). The instrument used in the examples to make these tests was a conventional scanning electron microscope having a nominal magnification range of $10\times$-$240{,}000\times$ with a resolution of 70 Å (the ETEC "Autoscan ®" SEM, manufactured by ETEC Corporation, Hayward, California). Samples to be examined under the SEM are mounted for observation on standard carbon or aluminum stubs 1.25-1.9 cm (0.5-0.75 in) in diameter, which are mounted in turn on a stage within the SEM. With respect to the electron beam, the stage can be tilted through an angle to the beam direction ranging from $+90°$ (towards the collector of electrons) to $-10°$ (away from the collector), the total tilting angle being 100°. The stage can also be rotated to any desired position around an axis parallel to the beam direction.

Fabrics are prepared for observation by cutting them with a fresh razor blade to provide a sample measuring 12 mm along the cross direction and 4 mm in the machine direction (arbitrarily selecting the most likely directions if machine and cross directions cannot be definitely identified). A 12 mm length of copper conducting tape, 6.35 mm (0.25 in) in width and having adhesive on one side, is cut and bent at right angles along the centerline of its length into an "L" shape as seen from one of the ends, with the adhesive on the outside of the "L". The long direction of the fabric sample is aligned with the long direction of one leg (the "top" leg) of the L-shaped tape and the side of the fabric sample having the raised surface (soft or fuzzy side) is adhered to the tape with approximately 1 mm of the raised surface projecting above the end of the leg of the tape. The bottom of the other leg (the "bottom" leg) of the tape is then mounted on the stub, so that the top leg of the tape (with the exposed 1 mm portion of the raised surface of the fabric projecting above its end) projects at a right angle from the stub.

The surface of the fabric sample, mounted as described above, is then provided in conventional manner with an extremely thin coating of gold metal by placing the stub carrying the sample in a high vacuum evaporator provided with a sputter module (such as the Model DV-502 evaporator equipped with a DSM-5 cold sputter module, manufactured by Denton Vacuum, Inc., Cherry Hill, N.J.) and depositing a thin coating of gold on the surface under a vacuum of approximately $10^{-5}$ torr. The electrical conductivity of the gold-coated sample is preferably enhanced by applying a dry film conductive lubricant (such as a conventional suspension of graphite in isopropanol) along the sides of the mounted sample in a coating which extends along the copper tape and reaches the stub.

Fibril Taper Test

Figure 4:
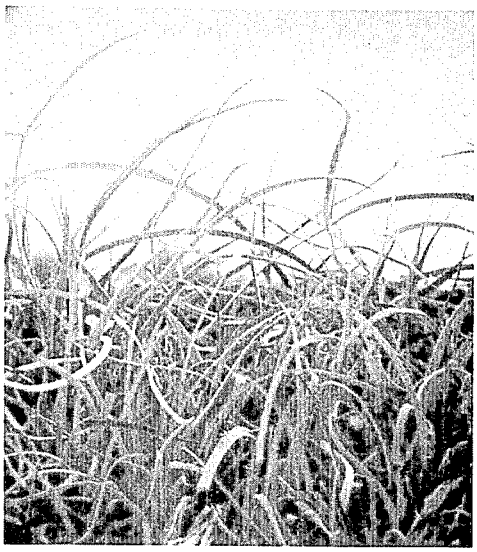
FIG. 4 is a photomicrograph at 100× magnification of a portion of FIG. 3.
Figure 5:
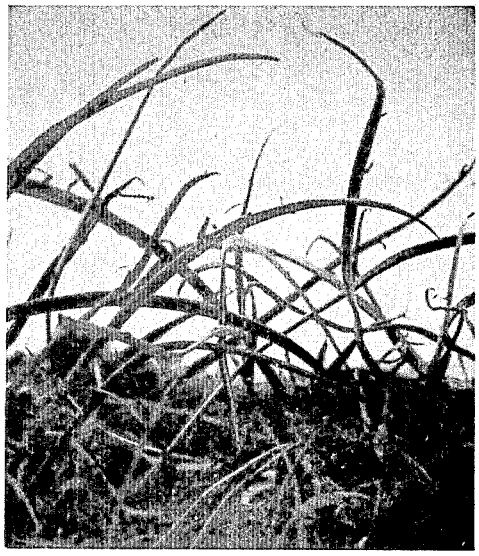
FIG. 5 is a photomicrograph at 200× magnification of the same general locus as FIG. 4.
Figure 6:
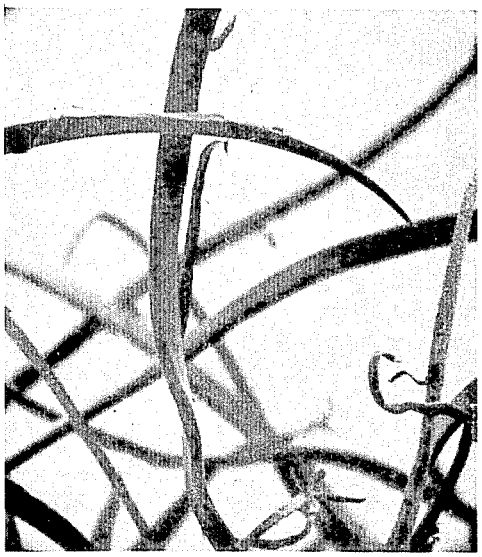
FIG. 6 is a photomicrograph at 500× magnification of the same general locus as FIG. 5.

A sample of fabric is mounted on a stub on an L-shaped tape as described above, with about 1 mm of fabric surface projecting above the end of the tape. The stage of the SEM is positioned with the bottom leg of the L-shaped tape pointing towards the collector of electrons and the top leg at 0° (vertical), so that the edge of the fabric is perpendicular to the electron beam with the surface facing the collector of electrons. The edge of the fabric is observed under the SEM at a magnification of $100\times$, and a representative area of the edge is selected and photographed at $100\times$ magnification (FIG. 4 is an example of such a photomicrograph) while continuing to keep the selected area under observation. For the purpose of this test all free ends observed are treated as fibril ends. All fibril ends which are identifiable in the 100× photomicrograph are rephotographed at a nominal 500× magnification, following each fibril end from its terminal point as far into the fabric as it can be observed, taking more than one photomicrograph at 500× magnification for a given fibril end if necessary. Of course, a single 500× photomicrograph may adequately include several fibril ends. Using the calibrated micron marker normally included on the photomicrograph for determination of exact lengths (or otherwise determining the exact magnification used), each fibril end which can be observed over a length of 100μ from its terminal point is measured to determine its width at three distances from its terminal point: at 2μ, 50μ, and 100μ. More particularly, referring to FIG. 2, the widths of fibril end 20 at distances of 2μ, 50μ, and 100μ from its terminal point 22 are $w_1$, $w_2$ and $w_3$, respectively. If a portion of the fibril end is blocked from view at 50μ or 100μ, the width is interpolated from the widths observed on each side of the blocked portion. The fibril end is counted as being tapered if the width increases continuously over the three measurements, beginning at the point 2μ from its terminal point (i.e., $w_1 < w_2 < w_3$). If fewer than 12 fibril ends are observed, additional photomicrographs are taken until 12 fibril ends have been observed. The percentage of those fiber or fibril ends in the 100× photomicrograph (or photomicrographs) which are tapered is then determined. The sample is considered to be comprised of tapered fibril ends if a majority (i.e., more than 50%) of the fibril ends is determined to be tapered as measured by this test. The widths at each distance (2μ, 50μ and 100μ) from the terminal points of those fibrils which are found to be tapered are also averaged and reported.

Test for Surface Density of Fibril Ends

In this test the sample is mounted as described above, with about 1 mm of fabric surface projecting above the end of the tape, and the stage of the SEM is first positioned with the bottom leg of the L-shaped tape pointing away from the collector of electrons and the top leg at 0° (vertical). The stage is then tilted down to the +90° position so that the electron beam is parallel to the stub surface and perpendicular to the exposed surface of the fabric. An SEM photomicrograph is then taken at 10× magnification. The distance between the edge of the fabric and the end of the leg of folded tape is then accurately determined by measuring on the 10× photomicrograph the height of the exposed surface perpendicular to the end of the tape and dividing by the magnification. The stage of the SEM is then tilted back to 0°, rotated 180° in the horizontal plane so that the bottom leg of the L-shaped tape is pointing towards the collector, and finally tilted to the −° position (so that the electron beam strikes the exposed fabric surface at an angle of 10°). An SEM photomicrograph at 50× magnification of an entire section of the projecting fabric sample is then taken, including in the photomicrograph the end of the tape and all of the edge of the fabric as well as the intervening fabric surface. A representative strip of fabric surface perpendicular to the end of the tape is selected on the 50× photomicrograph for examination at higher magnification. The SEM is then focused on the end of the copper tape, and a first photomicrograph at 500× magnification is taken. Moving in a direction perpendicular to the end of the copper tape, as viewed in the photomicrographs, the stub is appropriately adjusted to move the sample up through a distance of ½ of the field of view, refocusing on the fabric surface in the new center of the field of view and taking another photomicrograph at 500×. A series of photomicrographs is taken in this way, moving through a distance of ½ of the field of view each time until the photographed area is well down into the ground fabric portion of the fabric edge. When necessary for good observation of all fibril ends, two photomicrographs with different focusing are taken at a single location. Using this series of photomicrographs the number of fibril ends is then counted, identifying each fibril end from the overlapping photomicrographs so that none is counted twice. For the purpose of this test all free ends observed are treated as fibril ends, except that any fibril ends having a width smaller than 0.5 micron at the widest point are not counted. The width of the strip of fabric surface observed is determined by measuring the width of the photomicrographs taken and dividing by the magnification. The area of the strip of fabric surface observed is then calculated by multiplying the width so determined by the distance between the edge of the fabric and the end of the tape, determined as described at the beginning of this paragraph. The total number of fibril ends observed in the series of photomicrographs is then divided by the calculated area of the strip to give the surface density of fibril ends in the fabric sample. The test is repeated, sweeping another strip of fabric surface. If the results are quite divergent, two additional sweeps are made. The results of the various sweeps are averaged.

Test for Structure of Ground Fabric

For this test, the fabric sample is mounted and positioned in the same way described above for the "Fibril Taper Test". An SEM photomicrograph at a nominal 500× magnification of a representative area of the edge of the ground fabric is then prepared. The 500× photomicrograph is examined to determine the structure of the ground fabric. If this photograph reveals well-defined cross sections which are irregular and of different size, such that the cross sections have sharp and distinct peripheries, the ground fabric is considered to be comprised of discrete fibrils. Regular cross sections may be present.

Relative Viscosity (HRV)

HRV (Relative Viscosity in Hexafluoroisopropanol) is determined as described by Lee in U.S. Pat. No. 4,059,949, Co. 5, line 65 to Col. 6, line 6.

EXAMPLE 1

Poly(ethylene terephthalate/sodium 5-sulfoisophthalate) (98/2 mol ratio) having an HRV of about 15 was spun at a spinneret temperature of 265°-270° C. from a 50-hole spinneret, each hole consisting of a Y-shaped orifice formed by the intersections at 120 degree angles of three slots measuring 0.064 mm (2.5 mils) in width × 0.76 mm (30 mils) in length with one slot of each orifice pointed directly towards the source of the cross-flow quenching air. The extruded filaments were gathered by guides into a yarn, passed from a pair of feed rolls at a peripheral speed of 1243 mpm (1360 ypm) through a steam jet at 220° C. to a pair of annealing draw rolls in a box with an air temperature maintained at 135° C. and operated at a peripheral speed of 2742 mpm (3000 ypm), and forwarded by two additional pairs of rolls operated at peripheral speeds of 2744 mpm (3002 ypm) and 2747 mpm (3005 ypm), respectively, to a windup operated at a peripheral speed of 2662 mpm (2913 ypm). The overall draw ratio (feed to windup) was 2.34×. The 50-filament yarn so produced had a linear density of 9.44 tex (85 denier), an elongation of 8.1%, and a tenacity of 0.192 newtons per tex (2.17 gpd). The ratio of the length of the fins in the Y cross section of the drawn filaments to the width of the fins, as measured in a photomicrograph of the filament cross section, was 5:1.

A 22-cut jersey tubing was knitted ("Supreme" Knitting machine, manufactured by the Supreme Knitting Machine Co., Ozone Park, N.Y.) from ten 18.88 tex (170 denier) yarns, prepared by combining at the machine two ends of the 9.44 tex (85 denier) yarns prepared as described above for each of the ten yarns used. A tension of 3–5 g was used, and the runner length was 554 cm (222 in). The circular knit fabric which had a basis weight of 105 g/m$^2$ (3.1 oz/yd$^2$), was slit lengthwise. It was not heat-set.

Rectangular panels of the knit fabric measuring 81 cm (32 in) in the course direction and 119 cm (47 in) in the wale direction were placed course side up on a semit-will wire screen having a mesh of 37.8×39.4 openings per cm (96×100 openings per inch), with 21% open area, on a needling machine of the type shown in FIG. 1, with the long dimension of the panel in the machine direction. The panel was wet with water and then repeatedly passed at 13.7 mpm (15 ypm) under a hydraulic needling jet on a belt support, the jet consisting of a 61 cm (24 in) long thin metal strip containing a row of 0.13 mm (5 mil) holes spaced 15.75 holes per cm (40 holes per in) and supported at a distance of 3.8 cm (1.5 in) above the panel of fabric. It was passed once under a jet at a pressure of 6895 kPa (1000 psi), twice at a pressure of 13,790 kPa (2000 psi), and finally four more passes at 17,927 kPa (2600 psi). It was then turned over, and the same hydraulic needling sequence was repeated in a second cycle with the wales side up. Finally, it was turned over again and the same needling procedure repeated once more in a third cycle. After pot dyeing at the boil and heat-setting on a pin frame at 180° C., the fabric product had a basis weight of 129 g/m$^2$ (3.8 oz/yd$^2$). It had a very soft, luxurious hand and readily displayed the finger tracking effect characteristic of the fine suede leathers. The fabric product, a portion of which is shown in FIGS. 3–6, was lively and had excellent drape. Comparison of the fabric product with the knit fabric used as a starting material revealed that the bulk and cover had been markedly increased during needling. Fabric characterization data, obtained by measurement of scanning electron microscope photomicrographs of the fabric product, are listed in the table.

Panels of the fabric product were sewn into a sport shirt, which was wear-tested. After 100 hours' wear, it showed no sign of pilling, matting, or any other deficiency. It was warm and very comfortable to wear, owing to its super-soft surface. It was also highly absorbent, holding twice its weight of water after a spin cycle in a conventional home washing machine, and rapidly wicked water when dry, which added to its comfort as wearing apparel.

EXAMPLE 2

Two ends of 9.44 tex (85 denier) copolyester yarn, prepared as described in the first paragraph of Example 1, were combined with one end of a commercially available 34-filament, 7.8 tex (70 denier) yarn melt-spun from the same copolyester, except that the filaments were of trilobal cross section. In a photomicrograph of the cross section, the ratio of the circumference of a circumscribed circle drawn around the trilobal cross section to the circumference of an inscribed circle drawn upon the same cross section was 2:1. The combined yarns were woven into a fabric 61 cm (24 in) wide having a basket construction of 18 ends per cm (46 ends per in) of the combined yarn in the warp and 18.9 picks per cm (48 picks per in) of the same yarn in the filling, the weave pattern consisting of two picks per shed with the filling yarn going alternately over and under two ends of the combined warp yarn. The resulting fabric, which had a basis weight of 98 g/m$^2$ (2.9 oz/yd$^2$), had a coarsely woven appearance and frayed badly at cut edges unless handled carefully.

The fabric was cut into panels measuring 119 cm (47 in) in length and 61 cm (24 in) in width and the panels were then hydraulically needled, following the procedure of Example 1, using the following schedule of passes: first pass at a pressure of 6895 kPa (1000 psi), followed by four passes at a pressure of 13,790 kPa (2000 psi); the hydraulically needled panels were then removed from the screen and flipped over and the same needling procedure repeated in a second cycle on the opposite side of the fabric under the same conditions. The fabric panels were then boiled off, dyed, and heat set on a pin frame at 180° C.

The fabric, prepared as described above, had a very soft, suede-like hand. It was now a stable fabric resistant to fraying, with much improved bulk and cover. Its basis weight had increased to 122 g/m$^2$ (3.7 oz/yd$^2$), owing to shrinkage during needling and boil-off. Its thickness had increased to 0.96 mm, from 0.25 mm prior to needling, and its bulk had increased to 7.67 cc/gm after needling, owing to the pronounced bulking effect of fibrillation. Fabric characterization data, obtained by measurement of scanning electron microscope photomicrographs, are listed in the table.

EXAMPLE 3

Poly(ethylene terephthalate/5-sodium sulfoisophthalate) (98/2 mol ratio) having an HRV of about 15 and containing 0.3 weight percent $TiO_2$ was melt spun through a spinneret containing 46 orifices, each comprising a rectangular slot having the dimensions 0.05 mm×1.52 mm (2 mils×60 mils), the orifices being so positioned that the quench air was perpendicular to the long dimensions of the slots. The filaments were gathered by means of guides into a yarn, passed from a feed roll rotating at a peripheral speed of 1246 mpm (1363 ypm) through a steam jet at 220° C. to a pair of annealing draw rolls in a box with an air temperature maintained at about 130° C. and operated at a peripheral speed of 2742 mpm (3000 ypm), and forwarded by a roll operated at a peripheral speed of 2651 mpm (2900 ypm) to a windup operated at a peripheral speed of 2636 mpm (2884 ypm). The overall draw ratio was 2.3×. The resulting 46-filament yarn had a linear density of 11 tex (99 den), the individual filaments having a linear density of 0.24 tex per filament (2.2 dpf). The filaments were found to have a ribbon cross section with a length-to-width ratio of 7.0:1, the width of the cross section being 6μ. The yarn was found to have a five-ply tenacity of 1.6 dN/tex, and the individual filaments were found to have elongations ranging from 9 to 25% (elongation at maximum load 17%).

A jersey knit tubing was knitted on a circular knitting machine having a head 90 mm in diameter with 220 needles around the circumference of the head (Lawson-Hemphill, Inc. Knitting Machine 54 gauge head) from the yarn prepared as described above, plying two ends of the yarn together at the machine. The circular knit fabric so prepared was heat set at 165° C. for five minutes on a cardboard form and then slit lengthwise. Panels of the heat-set fabric were then hydraulically needled, following the procedure of Example 1, using the following schedule of passes: first pass course side up at 6895 kPa (1000 psi) followed by four passes at about 17,900 kPa (2600 psi); the panel was then flipped course side down and the same needling schedule repeated in a second cycle, after which the panel was flipped once again (course side up) and the needling schedule repeated once more in a third cycle. Each pass was carried out at 13.7 mpm. The needled fabric was boiled off, tumble dried 40 minutes, and heat set on a stretcher frame at 180° C. for five minutes. Fabric characterization data, obtained by measurement of scanning electron microscope photomicrographs, are listed in the table.

EXAMPLE 4

Yarn comprised of copolyester filaments of Y cross section, prepared substantially as described in Example 1, was cut to staple fibers having a cut length of 1.9 cm (0.75 in). The staple fibers were formed by a staple air lay web-forming machine ("Rando-Webber", manufactured by the Rando Machine Corp., The Commons—TR, Macedon, N.Y.) into a random staple fiber batt having a basis weight of 102 g/m$^2$ (3.4 oz/yd$^2$). The batt was hydraulically needled as in Example 2. After hydraulic needling, it was pot dyed at the boil and heat set on a pin frame at 180° C. The fabric so prepared was well entangled and had a soft, suede-like hand. Its surface comprised a multiplicity of tapered fibrils having very fine tips. Fabric characterization data, obtained by measurement of scanning electron microscope photomicrographs, are listed in the table.

EXAMPLE 5

Two ends of a 50-filament, 9.44 tex (85 denier) copolyester yarn of Y-cross section, similar to the yarn described in the first paragraph of Example 1, were plied to form a yarn having two turns per centimeter (5 turns per inch) of "S" twist. A knitted fabric having a jersey pattern was warp knit at 11 needles per centimeter (28 needles per inch) on a tricot machine with two guide bars, feeding to the front bar the plied copolyester yarn and feeding to the back bar one end of a commercially available 34-filament, 7.8 tex (70 denier) yarn melt-spun from the same copolyester, except that the filaments were of trilobal cross section like the yarn described in Example 2. The resulting fabric had a basis weight of 200 g/m$^2$ (5.2 oz/yd$^2$). Panels cut from this fabric were then hydraulically needled, following the general procedure of Example 1, using the following schedule of passes: first pass with the panels face side down at 6895 kPa (1000 psi) followed by 4 passes at about 17,900 kPa (about 2600 psi); then a second cycle with the panels flipped to the face up position and the same needling schedule repeated; and finally a third cycle with the panels flipped once again (face side down) and the same needling schedule repeated once more. Each pass was carried out at 5.7 mpm (6.2 ypm). The needled fabric was boiled off, tumbled dry, and heat set on a frame at 180° C. for 5 minutes. The fabric product, which had a basis weight of 245.6 g/m$^2$, had a soft, luxurious hand on both sides of the fabric. It was lively and had good drape, and had hand approaching that of suede leather without the fabric having been impregnated. Fabric characterization data, obtained by measurement of scanning electron microscope photomicrographs of the fabric products, are listed in the table. Two sets of data (designated as **5*a* and 5*b*** in the table) are listed, corresponding to measurements made on the two sides of the fabric.

EXAMPLE 6

A 34-filament, 5.89 tex (53 denier) copolyester yarn is prepared in a manner similar to that used in the first paragraph of Example 1, except that the spinneret contains 34 holes, each hole consisting of a Y-shaped orifice formed by the intersections at 120 degree angles of 3 slots measuring 0.076 mm (3 mils) in width×0.762 mm (30 mils) in length. The overall draw ratio was 2.2×. The copolyester yarn had an elongation of 5.61% and a tenacity of 0.191 newtons per tex (2.16 gpd).

The copolyester yarn was knitted into a jersey knit tubing on the same circular knitting machine described in Example 3, plying three ends of the yarn together at the machine. The circular knit fabric so prepared was heat-set on a cardboard frame and then slit lengthwise. Panels of the heat-set fabric were then hydraulically needled, following the procedure of Example 1, using the following schedule of passes: first pass course side up at 6895 kPa (1000 psi) followed by four passes at 17,900 kPa (2600 psi); then a second cycle with the panels flipped course side down and needled once at 6895 kPa (1000 psi), once at 12,410 kPa (1800 psi), and four times at 17,900 kPa (2600 psi); and finally a third cycle with the panels flipped once again (course side up) and the needling schedule of the second cycle repeated. Each pass was carried out at 13.7 mpm. The needled fabric was boiled off, tumbled dry, and heat-set. The fabric so prepared was lively, had good drape, and was characterized by a soft-suede like hand. It had a basis weight of 116 g/m$^2$ (3.41 oz/yd$^2$). Fabric characterization data, obtained by measurement of scanning electron microscope photomicrographs, are listed in the table.

Panels of hydraulically needled knit fabric, prepared substantially as described in Example 1, were impregnated with a composition comprising a polyether-type polyurethaneurea/plasticized polyvinyl chloride blend and buffed on a fabric sander. The impregnated fabric exhibited a very soft, suede-like hand similar to that of natural antelope suede and had the characteristics listed in the table under Item A.

Panels of hydraulically needled fabric prepared substantially as described in Example 6 were impregnated with a composition comprising a spandex polymer comprising a copolyester/urethane urea. The impregnated fabric had the characteristics listed in the table under Item B.

TABLE

Fabric Characterization Data Obtained By Measurement Of Scanning Electron Microscope Photomicrographs

| Ex. No. | Tapered fibril ends (% of all fibril ends) | Average width of fibril ends (μ) at distance from terminal point of 2μ | 50μ | 100μ | Fibril end density (No. per cm$^2$) |
|---|---|---|---|---|---|
| 1 | 100% | 2.1 | 5.3 | 7.2 | 41,000 |
| 2 | 88% | 2.2 | 5.0 | 6.7 | 25,000 |
| 3 | 81% | 2.2 | 5.9 | 7.8 | 14,500 |
| 4 | 87% | 2.9 | 5.5 | 7.4 | 25,500 |
| 5a | 87% | 2.1 | 4.5 | 6.7 | 19,500 |
| 5b | 92% | 2.7 | 6.0 | 7.3 | 18,500 |

TABLE-continued

| Fabric Characterization Data Obtained By Measurement Of Scanning Electron Microscope Photomicrographs | | | | | |
|---|---|---|---|---|---|
| Ex. No. | Tapered fibril ends (% of all fibril ends) | Average width of fibril ends (μ) at distance from terminal point of 2μ | 50μ | 100μ | Fibril end density (No. per cm$^2$) |
| 6 | 76% | 1.6 | 3.9 | 5.2 | 23,500 |
| Item A | 75% | 4.0 | 7.6 | 10.0 | 25,500 |
| Item B | 67% | 2.2 | 6.2 | 8.6 | 26,000 |

I claim:

1. A suede-like fabric structure including a ground fabric comprising discrete fibrils, said fibrils extending as fibril ends from said ground fabric at randomly spaced points of attachment to form one surface of the suede-like fabric having a density of from about 5000 to about 100,000 fibril ends per square centimeter, the majority of said fibril ends being tapered and having an average tip width of less than 10μ when measured a distance of about 2μ from the terminal point of said fibril ends, said fibril ends tapering to said tip width from a greater trunk width, the average trunk width being about 1.5 to 10× greater than said average tip width when measured a distance of about 100μ from the terminal point of said fibril ends.

2. The fabric as defined in claim 1, said suede-like fabric having a density of from about 10,000 to about 100,000 fibril ends per square centimeter.

3. The fabric as defined in claim 2, wherein said suede-like fabric structure is comprised of polyethylene terephthalate.

4. The fabric structure of claim 1, wherein said ground fabric comprises discrete fibers and fibrils.

5. The fabric as defined in claim 2, wherein said fabric structure is impregnated with soft polymer.

6. The fabric structure of claim 5, wherein said soft polymer is a polyurethane.

7. The fabric structure of claim 2, said ground fabric being a knit fabric.

8. The fabric structure of claim 2, said ground fabric being a woven fabric.

9. The fabric structure of claim 2, said ground fabric being a nonwoven fabric.

10. A method for producing a suede-like fabric structure in which fibril ends extend from a ground fabric at randomly spaced points of attachment and form one surface of the suede-like fabric, the method comprising:

forming a sheet-like structure of discrete fibers fibrillatable to tapered ends;

supporting the sheet-like structure on a foraminous support; and impinging the sheet-like structure on the foraminous support with needle like columnar streams of liquid at a pressure of at least 5000 kPa whereby said fibers are fibrillated to form a close spacing of fibril ends that extend from the sheet structure at randomly spaced intervals to form one surface of the suede-like fabric with the majority of said fibril ends being tapered.

11. The method as defined in claim 10, wherein said foraminous support is a fine mesh screen.

12. The method as defined in claim 10, including the additional steps of impregnating the fabric with soft polymer after it has been impinged with the streams of liquid and then buffing.

13. The method as defined in claim 10, said fibrillatable fibers being continuous filament yarns.

14. The method as defined in claim 10, said fibrillatable fibers being a batt of staple fibers.

15. The method of claim 11, said discrete fibrillatable fiber being a copolyester having a Y-shaped cross section formed by the intersection at 120 degree angles of three fins, the ratio of the cross sectional length of each to its width being about 5:1.

16. The method as defined in claim 12, said sheet-like structure being a woven fabric.

17. The method as defined in claim 12, said sheet-like structure being a knit fabric.

18. The method as defined in claim 12, said sheet-like structure being a nonwoven fabric.

* * * * *

UNITED STATES PATENT OFFICE
CERTIFICATE OF CORRECTION

PATENT NO. : 4,233,349

DATED : November 11, 1980

INVENTOR(S) : Donald O. Niederhauser

It is certified that error appears in the above-identified patent and that said Letters Patent are hereby corrected as shown below:

Col. 1, line 60, Change "designating" to -- designated --.

Col. 2, line 59, Change "forminous" to -- foraminous --.

Col. 3, line 34, Change "pKa" to -- kPa --.

Col. 7, line 53, Change "-°" to -- -10° --.

Col. 8, line 48, Change "Co." to -- Col. --.

Col. 12, line 46, Change "polyurethaneurea" to -- polyurethane urea --.

Col. 14, line 31, Change "Claim 11" to -- Claim 10 --.

Signed and Sealed this

*Fourteenth* Day of *April 1981*

[SEAL]

*Attest:*

RENE D. TEGTMEYER

*Attesting Officer*

*Acting Commissioner of Patents and Trademarks*